US005929353A

United States Patent [19]

Taninbaum

[11] Patent Number: 5,929,353

[45] Date of Patent: Jul. 27, 1999

[54] RESONATOR FOR MUSICAL REED INSTRUMENT

[75] Inventor: Wolfe Taninbaum, Fort Lauderdale, Fla.

[73] Assignee: Bari Associates, Inc., Fort Lauderdale, Fla.

[21] Appl. No.: 08/887,621

[22] Filed: Jul. 3, 1997

[51] Int. Cl.[6] ..... G10D 7/00

[52] U.S. Cl. ..... 84/380 R; 84/383 R

[58] Field of Search ..... 84/380 R, 383 R

[56] References Cited

U.S. PATENT DOCUMENTS

| | | | |
|---|---|---|---|
| 1,480,039 | 1/1924 | Alpers | 84/385 R |
| 4,212,223 | 7/1980 | Runyon | 84/383 R |
| 4,428,271 | 1/1984 | Winslow et al. | 84/383 R |
| 4,745,838 | 5/1988 | Johnson | 84/393 R |

*Primary Examiner*—William M. Shoop, Jr.
*Assistant Examiner*—Shih-yung Hsieh
*Attorney, Agent, or Firm*—Kramer, Levin, Naftalis & Frankel LLP

[57] ABSTRACT

A resonator for the mouthpiece of a musical reed instrument which solidifies and enhances the instrument's sound. The resonator fits on the tenon of the mouthpiece. The resonator includes an annular member with an inner surface dimensioned and sized to fit on the tenon. A coupling device is provided to releasably secure the resonator to the tenon.

14 Claims, 2 Drawing Sheets

RESONATOR FOR MUSICAL REED INSTRUMENT

BACKGROUND OF THE INVENTION

The present invention is directed generally to a resonator for the mouthpiece of a musical reed instrument. More particularly, the invention contemplates an annular member which is to be placed on the tenon portion of a mouthpiece for a saxophone or the like, in order to give added resonance and sound to the notes when the instrument is played.

Musical reed instruments such as saxophones include a neck portion having an annular cork retainer on the neck of the instrument body. The mouthpiece of the instrument is attached over the cork on the instrument neck. The mouthpiece includes a tenon which fits over and frictionally engages the cork retainer.

The prior art discloses various devices used to enhance the sound of musical reed instruments. Some of these devices modify or attach to the mouthpiece to achieve an enhanced sound. For example, U.S. Pat. Nos. 4,428,271 and 4,745,838 provide for different types of ligatures to hold the reed onto the mouthpiece which can be either adjusted to produce a different sound, or change the sound of the instrument by virtue of the ligature design. Another device disclosed by U.S. Pat. No. 4,212,223 consists of an internal sympathetic reed which alters the tone of the instrument. It is also known to provide a permanently affixed metal band on a hard rubber mouthpiece for ornamentation.

However, the prior art does not suggest or disclose a device which fits easily over the tenon portion of the mouthpiece to enhance the sound of the instrument. By so attaching the device disclosed in the present invention, vibrations are picked up, solidified and energized so that sound is intensely focused. This gathering of random vibrations cleans the sound and allows great volume to be applied when called for. The present device tends to add resonance to the sound of reeded instruments when played.

Accordingly, it is desired to provide a sound resonator whereby an annular member is adapted to be fitted on the tenon of the mouthpiece of a musical reed instrument.

SUMMARY OF THE INVENTION

Generally speaking, in accordance with the present invention, a resonator for the mouthpiece of a musical reed instrument is provided. The resonator includes an annular member which has an inner surface dimensioned and sized for fitting on the tenon of the mouthpiece. The annular member includes a coupling device for releasably locking the member onto the tenon.

In a preferred embodiment, the annular member is formed from brass. The coupling device includes a set-screw positioned on the outer surface and extending through the annular member and out of the inner surface. When tightened, the set-screw is pressed against the tenon to secure the member on the tenon.

Accordingly, it is an object of the present invention to provide a resonator device to enhance the sound of a musical reed instrument.

Yet another object of the present invention is to provide a resonator which is designed to fit easily on the tenon of the mouthpiece of a musical reed instrument, preferably a saxophone.

Still other objects and advantages of the invention will in part be obvious and will in part be apparent from the specification.

The invention accordingly comprises the several elements, and the relation of those elements with respect to each of the others, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
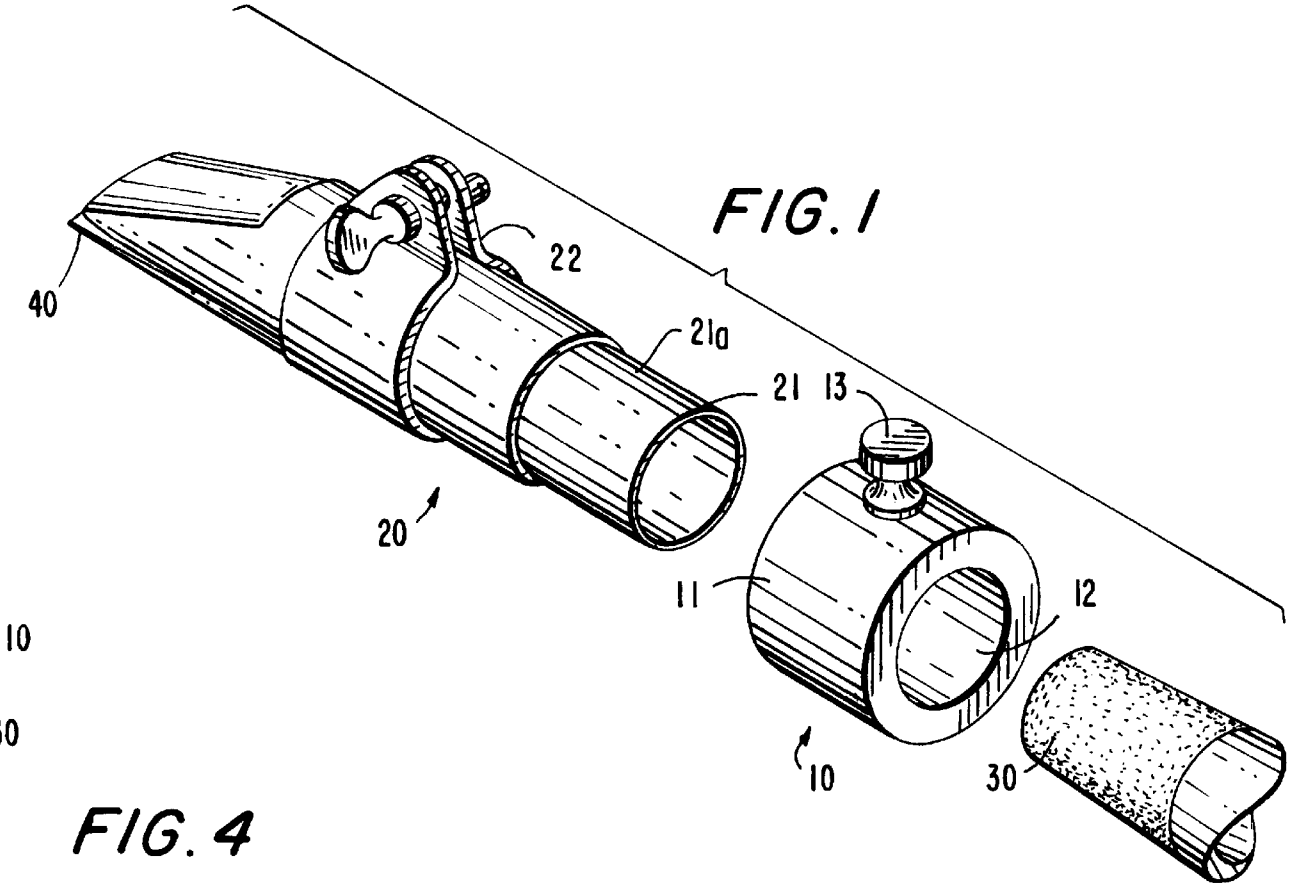
FIG. 1 is an exploded perspective view showing a resonator device according to the present invention before insertion on the mouthpiece of a musical reed instrument.

Reference is first made to FIG. 1 which depicts a resonator device, generally indicated at 10, which is used to enhance the sound of a musical reed instrument according to the present invention. FIG. 1 also depicts a mouthpiece of the musical reed instrument generally indicated at 20 having a tenon 21, and a neck of the instrument body 30. Mouthpiece 20 is preferably a gold-plated or nickel-plated metal mouthpiece.

Device 10 is in the form of an annular collar and includes an outer surface 11 and an inner surface 12. Inner surface 12 is dimensioned and sized for fitting on tenon 21 of mouthpiece 20 of the musical instrument, which itself fits on the neck 30 of the musical instrument. Collar 10 includes a coupling device in the form of a rotatable set-screw 13 positioned on outer surface 11 of collar 10. It is noted that other types of coupling devices could be used to releasably lock the collar 10 on tenon 21.

Mouthpiece 20 also includes a reed ligature indicated at 22 to hold a reed 40 thereon.

Figure 4:
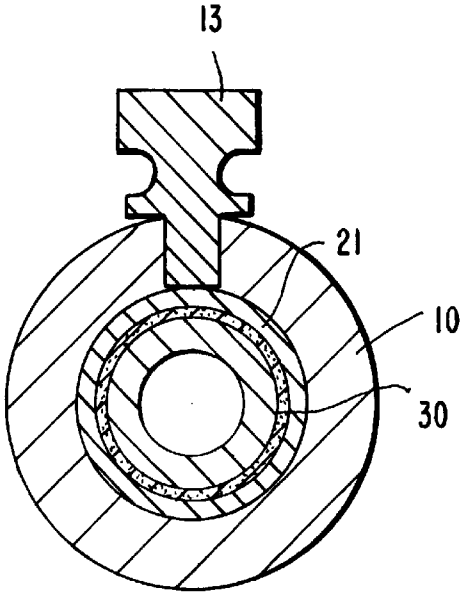
FIG. 4 is a sectional view taken along line 4—4 of FIG. 3.
Figure 2:
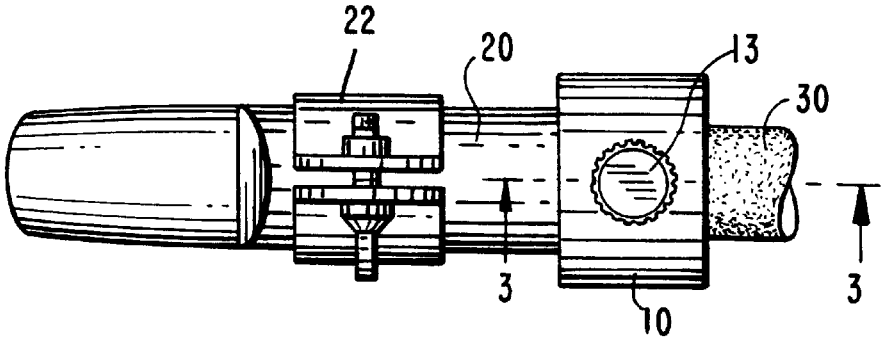
FIG. 2 is a top plan view of the musical reed mouthpiece depicted in FIG. 1 showing the resonator device in place thereon.
Figure 3:
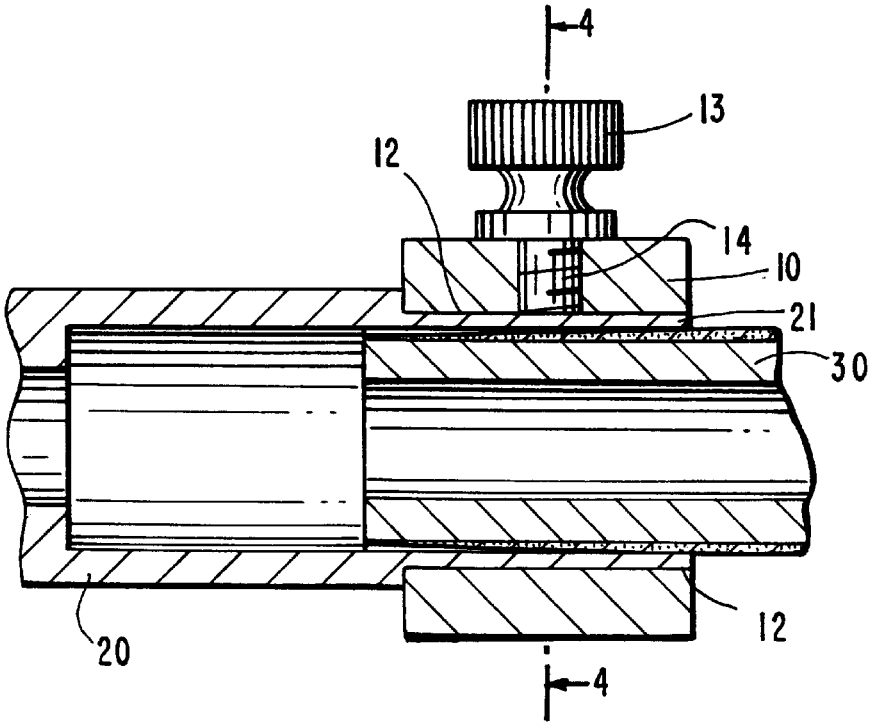
FIG. 3 is an enlarged sectional view taken along line 3—3 of FIG. 2.

Reference is now made additionally to FIGS. 2 through 4 to describe the present invention assembled with the mouthpiece and the musical instrument neck. When collar 10 is positioned on mouthpiece 20, collar 10 is positioned around tenon 21 of mouthpiece 20. Instrument neck 30 can then be inserted in tenon 21 as best depicted in FIG. 3.

When assembled, collar 10 is secured on tenon 21 by set-screw 13 which is tightened through a threaded opening 14. When tightened, set-screw 13 presses up against tenon 21 in order to secure device 10 thereon.

It is further illustrated that when device 10 is secured to mouthpiece 20, inner surface 12 of device 10 is flush with outer surface 21 a of tenon 21. Set-screw 13 is shown in the tightened position which is pressed up against tenon 21 in order to secure device 10 thereon.

Collar 10 is preferably formed from a brass material and has an outer diameter of about 1" and an inner diameter of between about ¼" and ⅝" depending on the size of the mouthpiece tenon.

The construction according to the present invention provides a resonator for a musical instrument which is relatively inexpensive to manufacture yet meets all of the benefits and advantages noted above. The resonator may be made heavy or light, depending upon the requirements of the user.

It will thus be seen that the objects set forth above, among those made apparent from the preceding description, are efficiently attained and, since certain changes may be made in the construction set forth without departing from the spirit and scope of the invention, it is intended that all matter contained in the above description and shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. A resonator for a mouthpiece of a musical reed instrument, said mouthpiece having a tenon portion for receiving the neck of said musical reed instrument, comprising an annular member, said annular member having an inner surface and an outer surface, said inner surface being dimensioned and sized for fitting on the tenon of said mouthpiece of said musical reed instrument, and coupling means for releasably locking said annular member on said tenon.

2. The resonator as claimed in 1, wherein said coupling means includes a set-screw, said set-screw positioned on said outer surface and extending through said annular member and out said inner surface for pressing against said tenon of said mouthpiece.

3. The resonator as claimed in claim 2, wherein the outer diameter of said annular member is about 1".

4. The resonator as claimed in claim 1, wherein said annular member is formed from brass.

5. The resonator as claimed in claim 4, wherein the inner diameter of said annular member is between about ¼" and ⅝".

6. The resonator as claimed in claim 4, wherein the outer diameter of said annular member is about 1".

7. The resonator as claimed in claim 6, wherein the outer diameter of said annular member is between about ¼" and ⅝".

8. A resonator for a mouthpiece of a musical reed instrument, said mouthpiece having a tenon portion for receiving the neck of said musical reed instrument, comprising an annular collar, said annular collar having an inner surface and an outer surface, said inner surface being dimensioned and sized for fitting on the tenon of said mouthpiece of said musical reed instrument, and a coupling device which releasably locks said annular collar on said tenon.

9. The resonator as claimed in 8, wherein said coupling device includes a set-screw, said set-screw positioned on said outer surface and extending through said annular collar and out said inner surface for pressing against said tenon of said mouthpiece.

10. The resonator as claimed in claim 9, wherein the outer diameter of said annular member is about 1".

11. The resonator as claimed in claim 10, wherein the outer diameter of said annular member is between about ¼" and ⅝".

12. The resonator as claimed in claim 8, wherein said annular collar is formed from brass.

13. The resonator as claimed in claim 12, wherein the outer diameter of said annular member is about 1".

14. The resonator as claimed in claim 13, wherein the inner diameter of said annular member is between about ¼" and ⅝".

* * * * *